US005752871A

United States Patent [19]

Tsuzuki

[11] Patent Number: 5,752,871

[45] Date of Patent: May 19, 1998

[54] RUNNING BODY

[75] Inventor: Akio Tsuzuki, Tokyo, Japan

[73] Assignee: Tomy Co., Ltd., Tokyo, Japan

[21] Appl. No.: 742,898

[22] Filed: Nov. 1, 1996

[30] Foreign Application Priority Data

Nov. 30, 1995 [JP] Japan ..... 7-013638

[51] Int. Cl.[6] ..... A63H 17/00; A63H 29/02; A63H 29/20

[52] U.S. Cl. ..... 446/457; 446/462; 180/22; 180/209

[58] Field of Search ..... 446/437, 457, 446/456, 462; 180/22, 24.06, 24.08, 24.02, 209

[56] References Cited

U.S. PATENT DOCUMENTS

| | | | |
|---|---|---|---|
| 3,540,151 | 11/1970 | Ishida . | |
| 4,674,585 | 6/1987 | Barlow et al. | 180/14.1 |
| 4,932,491 | 6/1990 | Collins, Jr. | 180/9.32 |
| 5,429,543 | 7/1995 | Tilbor et al. | 446/456 |

FOREIGN PATENT DOCUMENTS

| | | | |
|---|---|---|---|
| 132479 | 5/1989 | Japan | 180/22 |
| 3-19408 | 4/1991 | Japan . | |
| 2154152 | 9/1985 | United Kingdom | 446/462 |
| 2 182 859 | 5/1987 | United Kingdom . | |
| 2214099 | 8/1989 | United Kingdom | 446/443 |

*Primary Examiner*—Robert A. Hafer
*Assistant Examiner*—Laura Fossum
*Attorney, Agent, or Firm*—Nixon & Vanderhye PC

[57] ABSTRACT

A running body which can run at least forward or rearward includes a power source; a vehicle body including three vehicle body structural elements which are foldably connected to one another in series through axles, and a gear mechanism for driving wheels by the power source. The wheels are attached to the axles and other axles disposed on fore and rear portions of the vehicle body. At least one of the wheels is driven at a speed different from the others. A motor may be used as the power source and remote control for controlling the rotation of the motor may be also used, in order to give a variations of the figure of the running body.

10 Claims, 7 Drawing Sheets

RUNNING BODY

BACKGROUND OF THE INVENTION

1. Field of the Invention

The present invention relates to a running toy in which a plurality of vehicle body structural elements are foldably connected to one another.

2. Description of Related Art

Conventionally, a running toy in which a plurality of vehicle body structural elements are foldably connected to one another, is known, as shown in Japanese Utility Model Application Publication (Examined) No. Jitsukou-hei 3-19408. In this running toy, a vehicle body comprising a plurality of vehicle body structural elements in which the rear end of one vehicle body structural element is connected to the fore end of the next vehicle body structural element by an axle, each of folding portions of the respective vehicle body structural elements is adapted to be capable of folding further upwardly than downwardly, and a spring is disposed on the folding portion between the front vehicle body structural element and the next vehicle body structural element so that the front vehicle body structural element is urged so as to move upwardly by the spring. Further, a driving source is contained in a desired one of the vehicle body structural elements, transmission gears associated with the driving source are engaged with driving wheels attached to both ends of the axle, and the driving wheels are associated with each other through gear mechanisms which are disposed on the respective vehicle body structural elements.

Such a running toy runs on an irregular road surface while folding the vehicle body to adapt to the irregular surface. When the running toy runs against an obstacle, the running toy moves upwardly along with the vertical wall surface of the obstacle while folding the vehicle body, and thereafter, at the edge portion between the vertical wall and the top wall of the obstacle, it runs while folding the vehicle body to adapt to the edge portion. On a flat road surface, the running toy runs with a straight vehicle body.

As described above, this type of running toy runs on an irregular road surface while changing the figure of the vehicle body to adapt to the irregular surface. However, the vehicle body does not change the figure on a flat road surface.

SUMMARY OF THE INVENTION

The present invention was developed in view of the above-described problems. It is, therefore, an object of the present invention to provide a running toy which is capable of changing the figure of a vehicle body even while the running toy is running on a flat surface, in order to provide increased entertainment.

In accordance with one aspect of the present invention, the running body can run at least forward or rearward by rotating a motor normally or reversely by using a remote. The running body includes an electric power source; a motor member operated by the electric power source; a vehicle body including three vehicle body structural elements which are foldably connected to one another in series through axles, and a gear mechanism for driving wheels by a power of the motor member. The wheels are attached to the axles and disposed on fore and rear portions of the vehicle body. The gear mechanism includes a planetary gear mechanism for allowing the vehicle body structural elements to fold, and a ground speed of at least one of the wheels is different from the others in ground speed.

According to the above-described running body, since the ground speeds of the wheels are different from one another, the shape of the running body can be changed by controlling the motor by using the remote control. As a result, the running body gives increased enjoyment.

Preferably, the ground speeds of three of the wheels from one end of the vehicle body are reduced in the order of the first one, the second one and the third one. The ground speed of the fourth wheel may be the same as that of the third wheel. Preferably, the ground speed of the third wheel is less than that of the second wheel from the one end portion of the vehicle body by not less than 10 %. At least the others of the wheels may be different in size from one.

In the running body having a construction described above, for example, when the running body runs with the wheel having the smallest ground speed as the front position and with the wheel having the largest ground speed as the last, the running body runs with the intermediate wheel lifted, and when the running body is suddenly stopped in this condition, the rear vehicle body structural element gets over the front vehicle body structural element due to the inertia force thereof to rotate in the forward direction. When the running body runs with the wheel having the largest ground speed as the front position and with the wheel having the smallest ground speed as the last, and when the friction of the road surface is large, since the front wheel is larger and has a higher center of gravity than the next wheel, the front wheel is lifted, and vehicle body runs with this condition. Further, by adjusting the speed, the operation timing, or the like by the remote control, it is possible to run the running body with various figures even on an even surface.

Preferably, the motor member comprises a first motor for driving right wheels and a second motor for driving left wheels, which can be controlled independent of each other by the remote control. According to the running body having such a construction, it is also possible to spin the vehicle body by rotating the grounded right and left wheels in reverse directions.

In accordance with another aspect of the present invention, the running body which can run at least forward or rearward, includes a power source; a vehicle body including three vehicle body structural elements which are foldably connected to one another in series through axles, and a gear mechanism for driving wheels by the power source; The wheels are attached to the axles and disposed on fore and rear portions of the vehicle body, wherein a ground speed of at least one of the wheels is different from the others.

According to the above-described running body, since the ground speeds of the wheels are different from one another, the shape of the running body can be changed. As a result, the running body gives increased entertainment.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Figure 1:
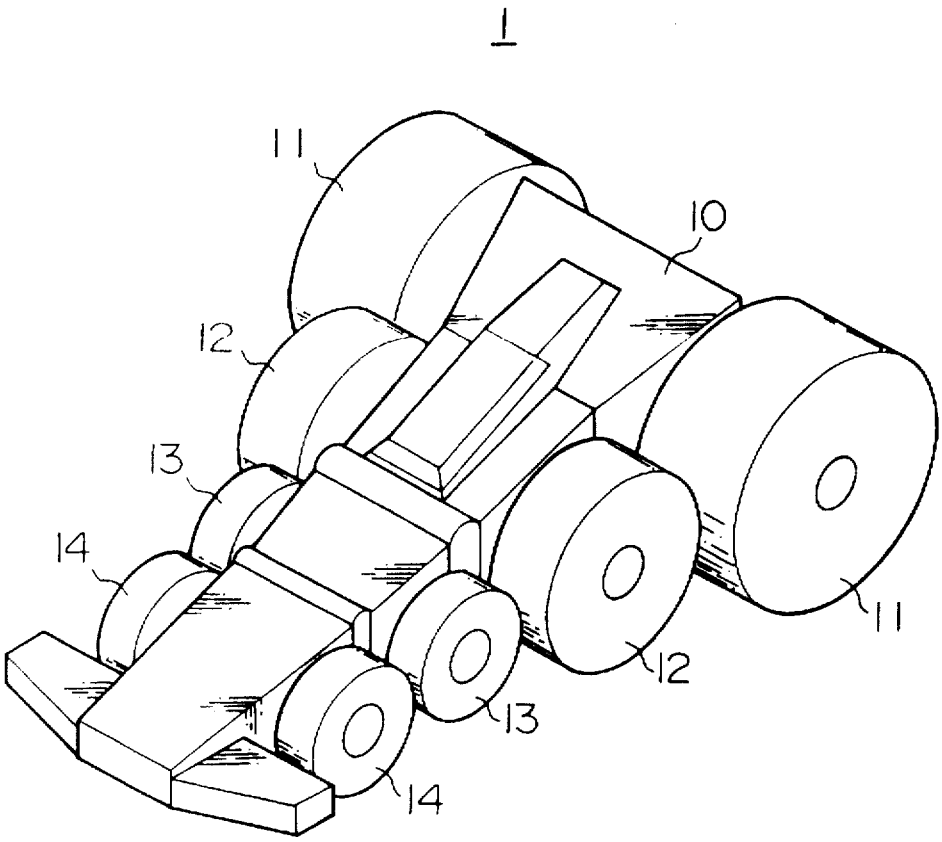
FIG. 1 is a perspective view of a running body according to an embodiment of the present invention.
Figure 2:
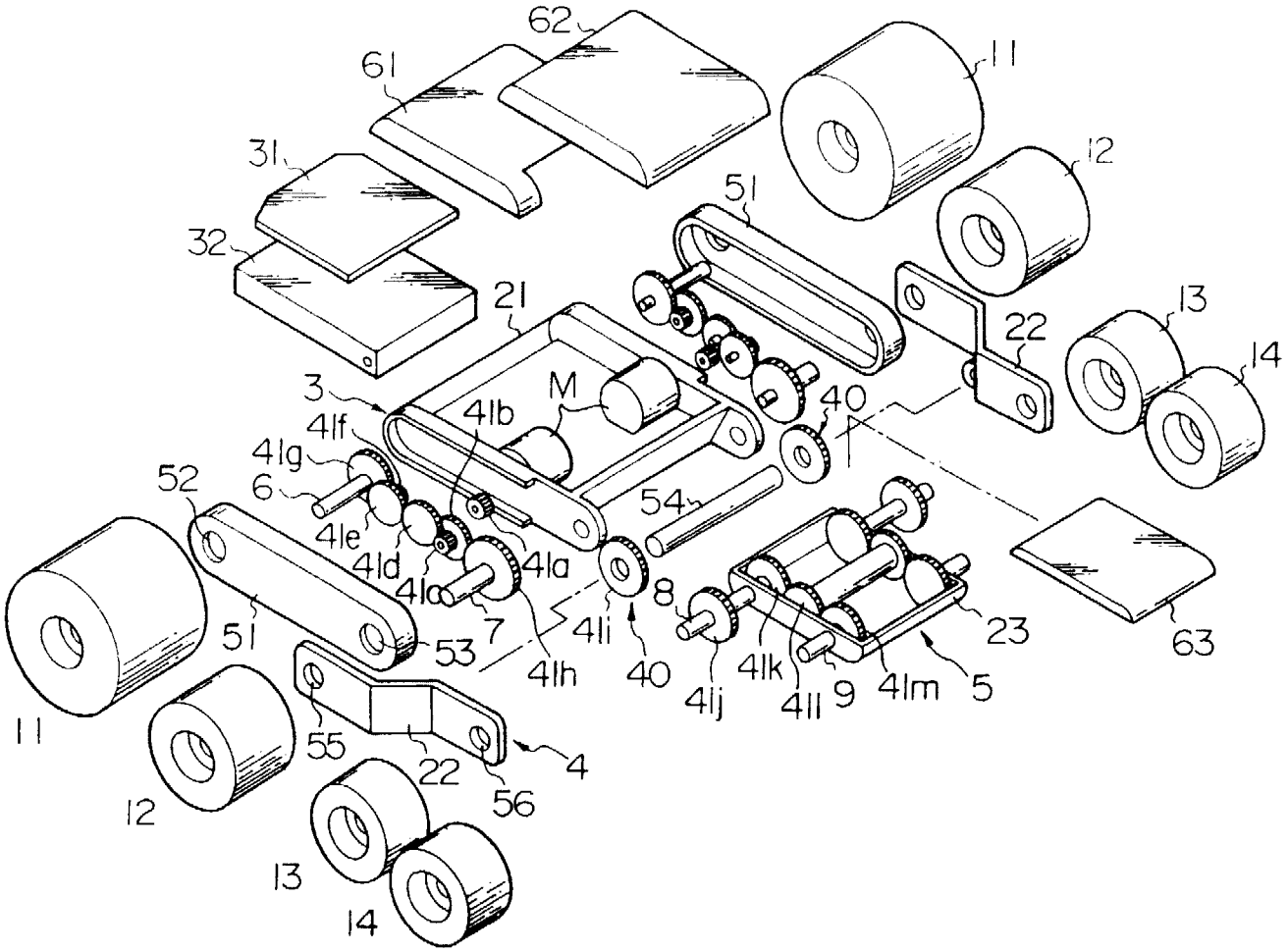
FIG. 2 is an exploded perspective view of the running body according to an embodiment of the present invention.
Figure 3A:
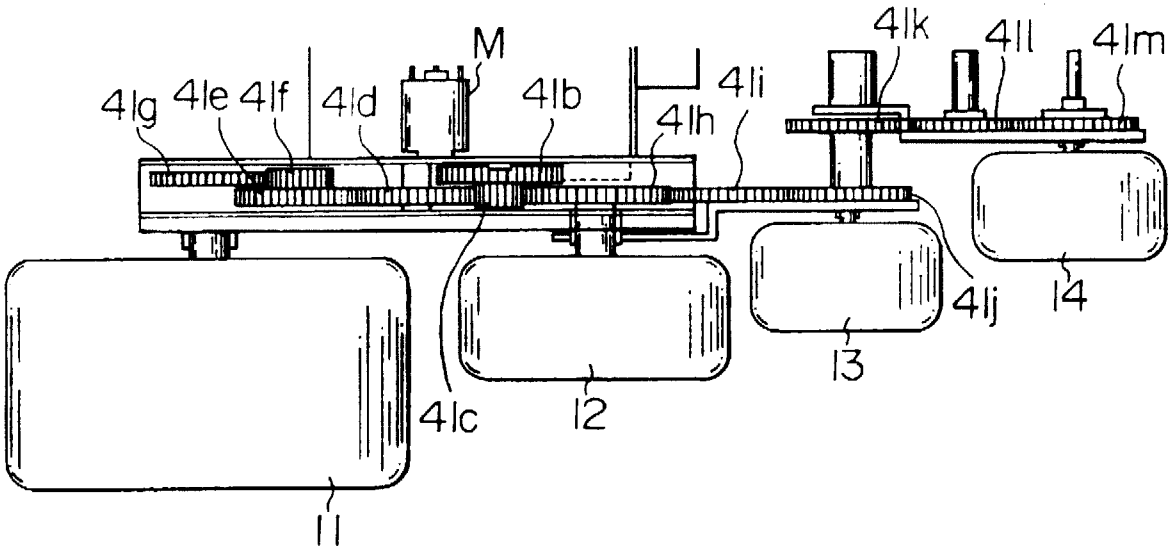
FIG. 3A is a plan view showing a gear mechanism and the like, of the running body according to an embodiment of the present invention.
Figure 3B:
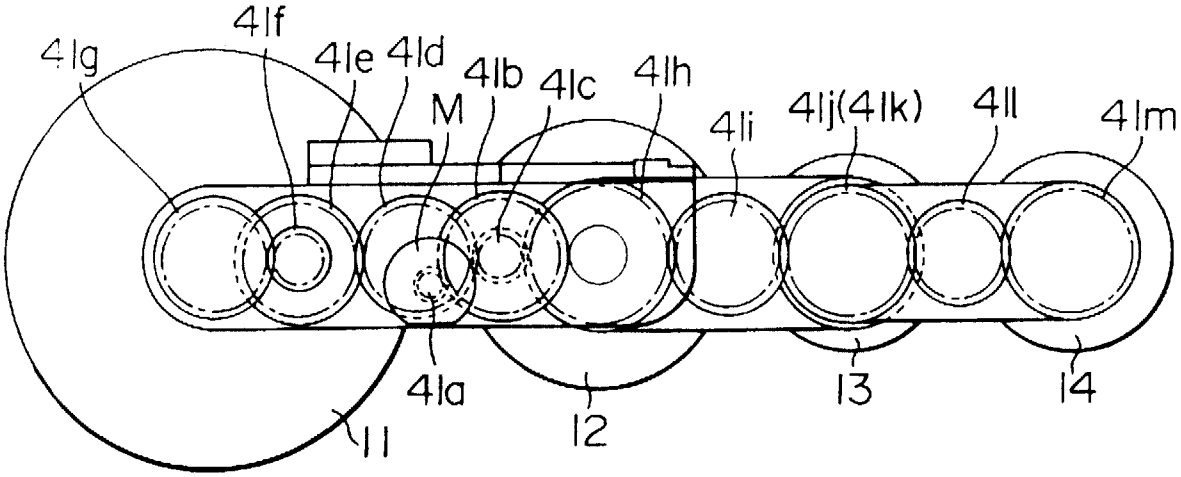
FIG. 3B is a schematic side view showing the gear mechanism and the like, shown in FIG. 3A.

FIG. 1 shows a running body according to an embodiment of the present invention. This running body 1 comprises three vehicle body structural elements 3, 4 and 5, as shown in FIG. 2. A vehicle body 10 is constituted in such a manner that these vehicle body structural elements 3, 4 and 5 are connected in series in the described order. In other words, as shown in FIG. 2, one end portion of the vehicle body structural element 4 and the vehicle body structural element 3 are connected foldably to each other through the axles 7 which are disposed on the vehicle body structural element 3, and the other end portion of the vehicle body structural element 4 and the vehicle body structural element 5 are connected foldably to each other through the axles 8 which are disposed on the vehicle body structural element 5. Further, axles 6 and 9 are disposed at both end portions of the vehicle body in a longitudinal direction. Wheels 11, 12, 13 and 14 are attached to the axles 6, 7, 8 and 9, respectively. Diameters and widths, of the wheels 11, 12 and 13 decrease according to the order as shown in FIGS. 3A and 3B. The wheel 14 has the same diameter and width as those of the wheel 13.

The vehicle body structural element 3 comprises a chassis 21, the vehicle body structural element 4 comprises a pair of links 22 and 22, and the vehicle body structural element 5 comprises a chassis 23.

A base 31 on which a receiver and the like are mounted, a battery, e.g., a Ni-Cd battery or the like, which is a power source, and a pair of motors M and M are mounted on the chassis 21 of the vehicle body structural element 3. A gear mechanism 40 for transmitting the motor power of each motor M to the wheels 11, 12, 13 and 14 is mounted on the vehicle body 10.

This gear mechanism 40 will be explained hereinafter with reference to FIG. 2 and FIGS. 3A and 3B. Since the gear mechanism 40 is bilateral symmetrical, explanation for only one side part thereof will be carried out. The motor power is transmitted to the wheel 11 through gears 41*a*, 41*b*, 41*c*, 41*d*, 41*e*, 41*f*, and 41*g*; the motor power is transmitted to the wheel 12 through gears 41*a*, 41*b*, 41*c*, and 41*h*; the motor power is transmitted to the wheel 13 through gears 41*a*, 41*h*, 41*i*, and 41*j*; and the motor power is transmitted to the wheel 14 through gears 41*a*, 41*h*, 41l, 41*j*, 41*k*, 41*i*, and 41*m*. The gear 41*a* is a pinion gear attached to the motor shaft, and the gears 41*g*, 41*h*, 41*j* and 41*k* are fixedly provided on the axles 6, 7, 8 and 9, respectively.

The gears 41*a* to 41*h* are disposed on a side surface of the chassis 21 and are covered by a cover 51 which is attached to the side surface of the chassis 21. Axle holes 52 and 53 are formed in the cover 51 at both end portions thereof. The leading ends of the axles 6 and 7 pass through the axle holes 52 and 53, respectively.

The gear 41*i* is freely-rotatably provided on a shaft 54 both ends of which are fixed to the right and left links 22 and 22. Each link 22 is bent, and at both ends of each link 22, axle holes 55 and 56 are formed. The leading ends of the axles 7 and 8 pass through the axle holes 55 and 56, respectively.

The gears 41*j* to 41*m* are disposed on the chassis 23. The gear 41*j* is disposed outside the chassis 23, and the other gears 41*k* to 41*m* are disposed inside the chassis 23.

In FIG. 2, reference numerals 61, 62 and 63 denote upper covers for the vehicle body structural elements 3, 4 and 5, respectively. In the running body 1 of the embodiment, when the ground speed of the wheel 11 is assumed to be 100, the ground speed of the wheel 12 is 98.5, and the ground speed of the wheel 13 and 14 is 88.8.

Figure 4A:
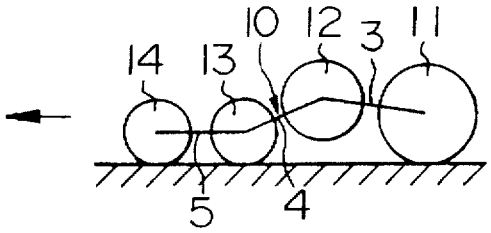
FIG. 4A is a schematic side view showing an operating condition of the running body according to an embodiment of the present invention.
Figure 4B:
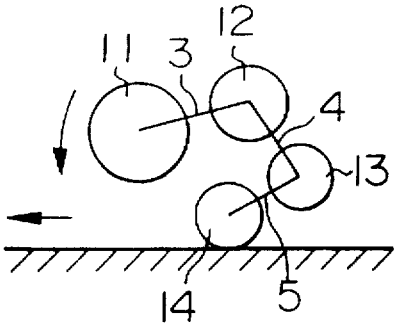
FIG. 4B is a schematic side view showing another operating condition of the running body according to an embodiment of the present invention.
Figure 4C:
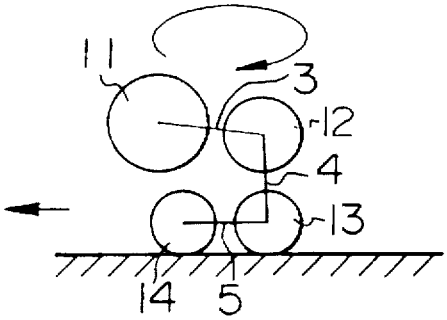
FIG. 4C is a schematic side view showing another operating condition of the running body according to an embodiment of the present invention.
Figure 4D:
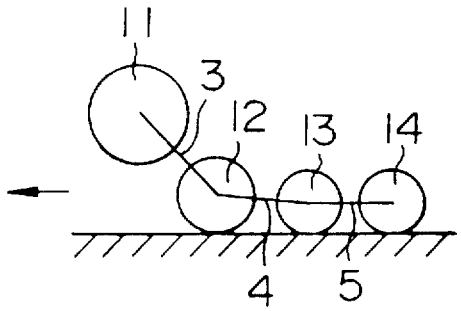
FIG. 4D is a schematic side view showing another operating condition of the running body according to an embodiment of the present invention.

In the running body 1 constituted as described above, in a case where the running body 1 runs with the wheel 14 as the front, the ground speed of the wheel 14 is less by 10 % than that of the wheel 11, so that the running body 1 runs with the wheel 12 lifted, as shown in FIG. 4A. When the running body 1 is suddenly stopped in this condition, the vehicle body structural element 3 climbs over the vehicle body structural element 5 due to the inertia force thereof to rotate in the forward direction, as shown in FIG. 4B. By suitably adjusting the speed thereof in the condition shown in FIG. 4B, it is possible to run the vehicle body 10 with a fixed figure of a C-like shape, as shown in FIG. 4C, or it is also possible to spin the vehicle body 10 by rotating the grounded left and right wheels in opposite directions. Meanwhile, in a case where the running body 1 is run with the wheel 11 as the front, the wheel 11 normally contacts the ground, and the wheels 13 and 14 are dragged due to the speed of the wheel 11. However, when the friction of the road surface is large, since the wheel 11 is larger and higher in location of center of gravity than the wheel 12, the wheel 11 is lifted as shown in FIG. 4D, and the vehicle body 10 runs in this condition.

Figure 4E:
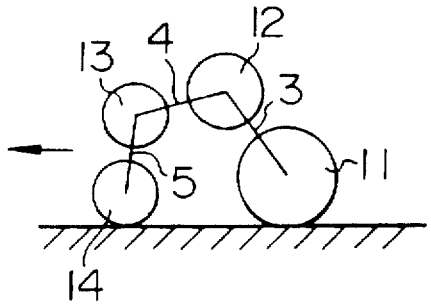
FIG. 4E is a schematic side view showing another operating condition of the running body according to an embodiment of the present invention.
Figure 4F:
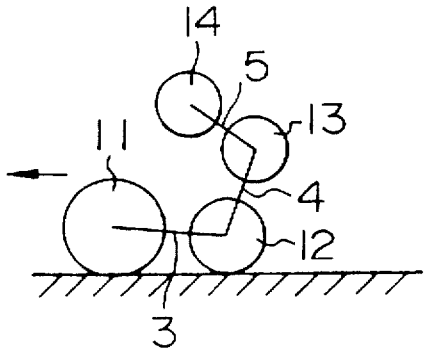
FIG. 4F is a schematic side view showing another operating condition of the running body according to an embodiment of the present invention.
Figure 4G:
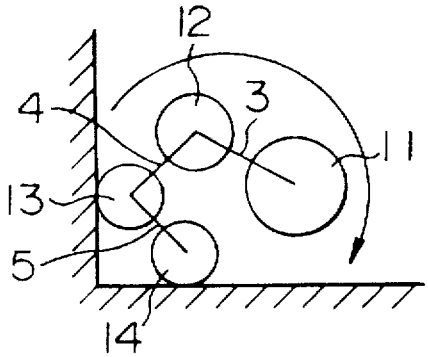
FIG. 4G is a schematic side view showing another operating condition of the running body according to an embodiment of the present invention.

Further, by adjusting the operation timing of the operating lever of the remote control, the vehicle body 10 can be run by the wheels 11 and 14, as shown in FIG. 4E; can be run by the wheels 11 and 12, as shown in FIG. 4F; or can be turned, as shown in FIG. 4G.

According to the running body 1 constituted as described above, since the ground speed of a wheel is different from that of the others, the Figure of the running body can be changed even while running on a flat surface in a case where the motor is controlled by the remote control. Such a running body is capable of giving increased entertainment based on the change of the figure thereof.

Although the present invention has been explained according to the embodiments, it should also be understood that the present invention is not limited to the embodiments and that various changes and modifications may be made to the invention without departing from the gist thereof.

In the above-described embodiment, only a running body having a motor which can be controlled using a remote control is explained. However, the present invention can be applied to any running body, so long as such a running body includes a power source; a vehicle body including three vehicle body structural elements which are foldably connected to one another in series through axles, and a gear mechanism for driving wheels by the power source. The wheels are attached to the axles disposed on fore and rear portions of the vehicle body, wherein at least one of the wheels is configured to rotate at a ground speed that is different from the other wheels. Use of a remote control is not essential for the present invention. The power source may be a mechanical power source, e.g., a power source comprising a spiral spring.

According to the running body having such a construction, since the ground speed of a wheel is different from that of other wheels the configuration of running body can be changed even while running on a flat surface. Such a running body is also capable of increasing enjoyment.

In the above-described embodiment, when the ground speed of the wheel 11 is assumed to be 100, the ground speed of the wheel 12 is 98.5, and the ground speeds of the wheels 13, 14 each is 88.9. However, it is of course that the ratio thereof is not restricted thereto. Also, the ground speeds of all the wheels may be changed. Further, the ground speeds of the wheel 11 and the wheel 12 may be made identical with each other. Even in this case, if the ground speed of the wheel 11 is made less by over 10% than that of the wheel 13, the running body 1 can be run similarly to the above-described embodiment.

By using a motor and a remote control for controlling the rotation of the motor, the configuration of the running body can be changed. As a result, such a running body is capable of giving increased entertainment with a lot of variations of the figure thereof.

What is claimed is:

1. A running body which can run at least in a forward direction, comprising:

an electric power source;

a motor member operated by the electric power source;

a vehicle body comprising three vehicle body structural elements foldably connected to one another in series through first and second axles;

a plurality of wheels coupled to at least the first and second axles;

a gear mechanism coupled between the motor member and the plurality of wheels the gear mechanism driving the wheels by a power of the motor member, wherein the gear mechanism includes a planetary gear mechanism coupled with the motor member for allowing the vehicle body structural elements to fold, and wherein ground speeds of first, second and third ones of the wheels are different from each other such that the ground speeds from one end of the vehicle body are reduced in the order of the first one, the second one and the third one.

2. A running body as claimed in claim 1, wherein at least four wheels are attached to each side of the vehicle body, the ground speed of a fourth wheel being the same as that of the third wheel.

3. A running body as claimed in claim 2, wherein the ground speed of the third wheel is less than that of the second wheel from the one end portion of said vehicle body, by not less than 10 %.

4. A running body as claimed in claim 1, wherein the ground speed of the third wheel is less than that of the second wheel from the one end portion of said vehicle body, by not less than 10 %.

5. A running body as claimed in claim 1, wherein at least some of the plurality of the wheels are different in size from others of the plurality of wheels.

6. A running body as claimed in claim 1, wherein the motor member comprises a first motor for driving right wheels and a second motor for driving left wheels, the first and second motors being controlled independent of each other by a remote control.

7. A running body which can run at least forward comprising:

a power source;

a vehicle body comprising three vehicle body structural elements foldably connected to one another in series through axles;

a plurality of wheels attached to the vehicle body;

a gear mechanism coupled with the plurality of wheels, the gear mechanisms driving the wheels by the power source wherein ground speeds of first, second and third ones of the wheels are different from each other such that the ground speeds from one end of the vehicle body are reduced in order of the first one, the second one and the third one.

8. A running body as claimed in claim 7, wherein at least four wheels are attached to each side of the vehicle body, the ground speed of a fourth wheels being the same as that of the third wheel.

9. A running body as claimed in claim 7, wherein the ground speed of the third wheel is less than that of the second wheel from the one end portion of said vehicle body, by not less than 10 %.

10. A running body as claimed in claim 7, wherein at least some of the plurality of the wheels are different in size from others of the plurality of wheels.

* * * * *